United States Patent [19]

Newton

[11] 4,265,093

[45] May 5, 1981

[54] EVAPORATOR FEED AND CONTROL SYSTEM

[75] Inventor: Alwin B. Newton, York, Pa.

[73] Assignee: Borg-Warner Corporation, Chicago, Ill.

[21] Appl. No.: 72,538

[22] Filed: Sep. 4, 1979

[51] Int. Cl.[3] ..... F25B 41/00; F25B 39/02; G05D 15/00

[52] U.S. Cl. ..... 62/198; 62/526; 165/38; 165/133

[58] Field of Search ..... 62/198, 526, 524, 209; 165/35, 38, 133

[56] References Cited

U.S. PATENT DOCUMENTS

| | | | |
|---|---|---|---|
| 2,440,534 | 4/1948 | Atchison | 62/198 |
| 2,669,099 | 2/1954 | Malkoff | 62/526 |
| 2,707,868 | 5/1955 | Goodman | 62/196 |
| 2,806,674 | 9/1957 | Biehn | 62/524 |
| 3,384,154 | 5/1968 | Milton | 165/133 |

*Primary Examiner*—Henry C. Yuen
*Assistant Examiner*—Harry Tanner
*Attorney, Agent, or Firm*—Thomas B. Hunter

[57] ABSTRACT

An evaporator feed and control system maintains a relatively high level of stability over a wide range of varying loads. The evaporator system includes a first evaporator having a multiple pass inlet and a single pass outlet, and a second evaporator having an inlet and an outlet. The inlet of the second evaporator is connected to the output of the first evaporator. A control valve device is utilized for bypassing at least a portion of refrigerant-oil flowing in the first evaporator from the second evaporator directly to a suction line when system is operating at a reduced capacity.

8 Claims, 5 Drawing Figures

EVAPORATOR FEED AND CONTROL SYSTEM

BACKGROUND OF THE INVENTION

1. Field of the Invention

This invention relates generally to refrigerating apparatus and more particularly, it relates to an evaporator feed and control system which provides a high level of stability over a wide range of varying load conditions. This invention has specific applications with controlled displacement compressors in which a minor stroking is maintained at minimum capacity.

2. Description of the Prior Art

In U.S. Pat. No. 2,806,674 issued to G. L. Biehn on Sept. 17, 1957, there is disclosed a heat pump having an indoor air coil formed of three vertical rows of finned tubes and an additional vertical row of finned tubes located upstream thereof.

In U.S. Pat. No. 2,707,868 issued to W. Goodman on May 10, 1955, there is disclosed a refrigeration system having a mixing valve which is responsive to the superheat of the refrigerant in the return conduit for feeding a mixture of liquid and gaseous refrigerant to a supply header in various proportions in accordance with the superheat.

It is generally known in the refrigeration art to pass liquid refrigerant through an expansion valve or a similar device and into a distributing header of an evaporator to effect the desired cooling of air or other fluid which is passed over the surfaces of the evaporator. While desired operation of the evaporator is usually reached during its full or rated capacity condition, it has been encountered heretofore in the industry that where an evaporator is being utilized at a low or partial level of its full capacity even distribution of liquid refrigerant through the plurality of tubes forming the evaporator is very difficult to maintain. It would, therefore, be desirable to provide an evaporator system which will supply even or stable distribution of liquid refrigerant to the evaporating tubes during a wide range of partial load conditions as well as at full load or capacity.

In the usual refrigeration systems, a mixture of liquid refrigerant and a relatively small amount of oil circulates throughout the system. Since the oil comes from the compressor crankcase, it must be returned thereto so as to prevent the depletion of the supply in the crankcase thereby causing compressor failure. It would be thus desirable to provide a refrigeration system having an evaporator wherein the unevaporated oil will be returned to the compressor along with the refrigerant vapor leaving the evaporator.

Since it has been recognized in practice that the load on the evaporator may vary considerably, it would also be desirable to vary the supply of refrigerant flowing within the evaporator in response to such variations. Thus, there is provided in the present invention an evaporator having valve means connected at its outlet to bypass a portion or all of the refrigerant to the compressor when a low or zero capacity is required.

SUMMARY OF THE INVENTION

Accordingly, it is a general object of the present invention to provide an evaporator system which maintains a relatively high level of stability over a wide range of varying load conditions.

It is another object of the present invention to provide an evaporator feed and control system wherein a first evaporator has a multiple pass inlet and a single pass outlet, a second evaporator has its inlet connected to the outlet of the first evaporator, and a control valve device is further coupled to the single pass outlet to bypass a portion or all of the refrigerant flowing in the first evaporator from the second evaporator directly to a suction line when the system is operating at a reduced capacity.

It is another object of the present invention to provide a first evaporator having a multiple pass inlet and a single pass outlet, the first evaporator being formed of at least two parallel rows of return-bend coils to thoroughly mix the refrigerant in the multiple pass portion to ensure a homogeneous exit.

It is still another object of the present invention to provide an evaporator having a multiple pass inlet and a single pass outlet, the evaporator being formed of at least two parallel rows of return-bend coils connected in a downfeed configuration which cross-over substantially half-way between the inlet and the outlet.

It is still another object of the present invention to provide a multiple pass inlet evaporator with the tubes thereof being coated internally with a porous surface to ensure immediate boiling of liquid refrigerant after it enters the inlet of the evaporator.

It is still another object of the present invention to provide an evaporator feed and control system consisting of a first evaporator having a multiple pass inlet and a single pass outlet, and a second evaporator formed of a single upfeed tube configuration being connected to the outlet of the first evaporator.

It is still yet another object of the present invention to provide a first evaporator having a multiple pass inlet and a second evaporator with tubes adjacent its outlet being affixed with augmenters to facilitate superheating of the refrigerant.

In accordance with these aims and objectives, the instant invention is concerned with the provision of an evaporator feed and control system which includes a first evaporator, a second evaporator and a control valve device. The first evaporator has a multiple pass inlet and a single pass outlet. The second evaporator has its inlet connected to the outlet of the first evaporator. The valve device is adapted to bypass at least a portion of refrigerant-oil flowing in the first evaporator from the second evaporator directly through a suction line to the compressor when the system is operating at a reduced capacity.

The first evaporator is formed of at least two vertical rows of tubes arranged generally in parallel planes and in a downfeed configuration. The vertical rows of tubes are crossed-over and interlaced halfway between the inlet and outlet of the first evaporator. In addition, the second evaporator is formed of a single upfeed tube configuration.

The instant invention is particularly efficient and economical in providing a new and improved evaporator system since the configuration of the first evaporator maintains an even distribution of the refrigerant oil and supplies a thorough mixture at its outlet. Further, the control valve device in the present invention maintains a relatively high level of stability in the evaporator system over a wide range of varying loads.

BRIEF DESCRIPTION OF THE DRAWINGS

These and other objects and advantages of the present invention will become more fully apparent from the following detailed description when read in conjunction with the accompanying drawings wherein.

DETAILED DESCRIPTION OF THE PREFERRED EMBODIMENT

Figure 1:
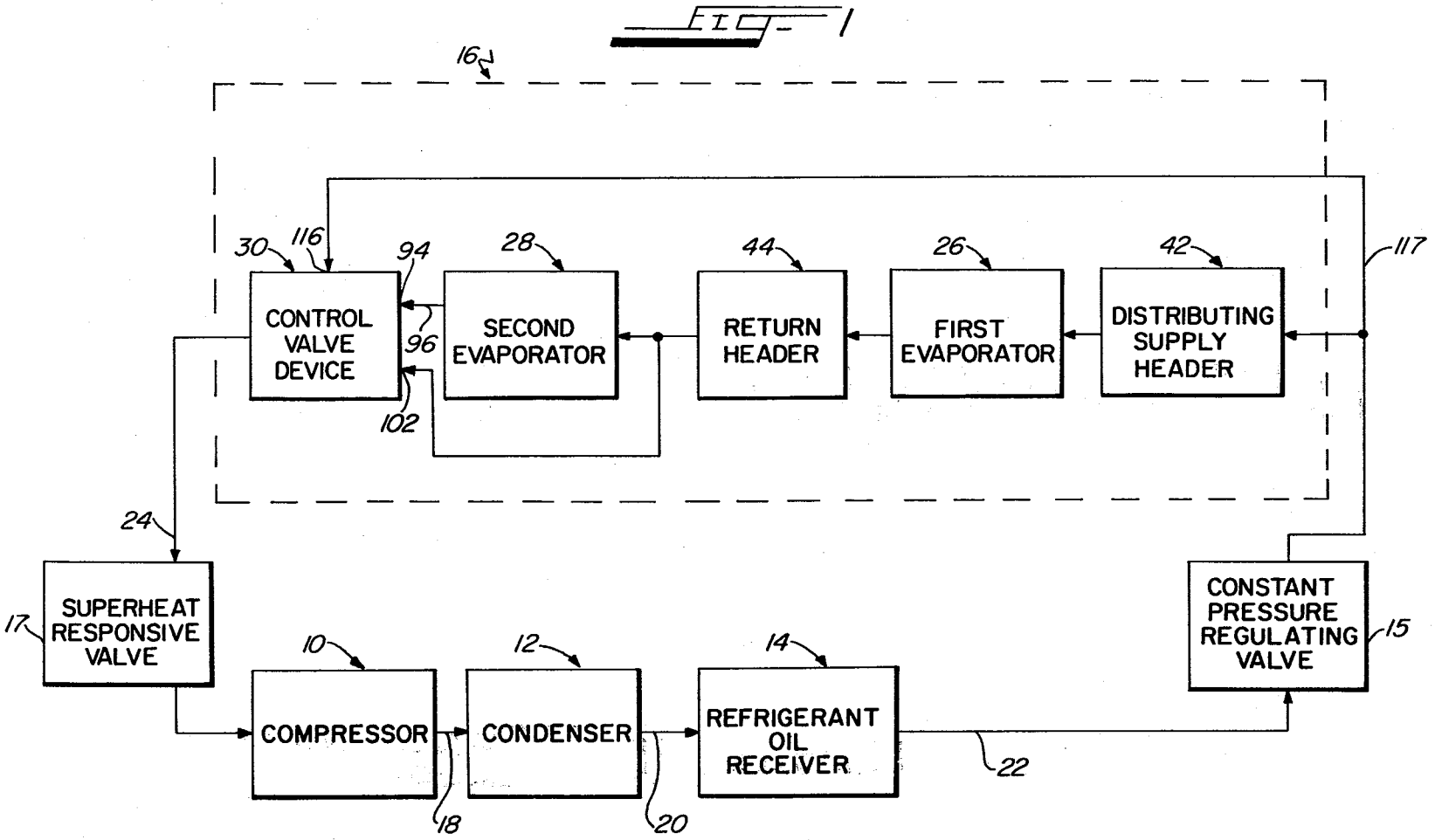
FIG. 1 is a schematic in block diagram form of the refrigerating apparatus, according to the present invention.
Figure 3:
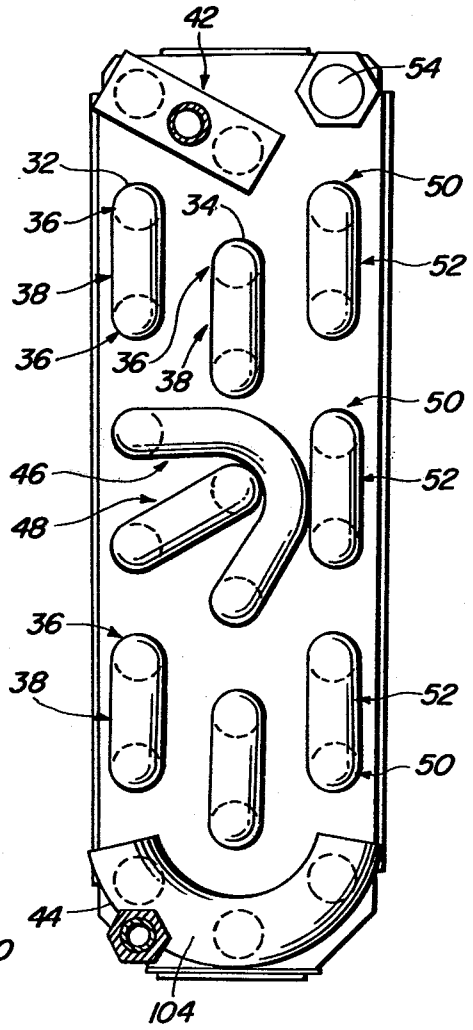
FIG. 3 is an end view of the evaporators taken along the lines 2—2 of FIG. 2.
Figure 2:
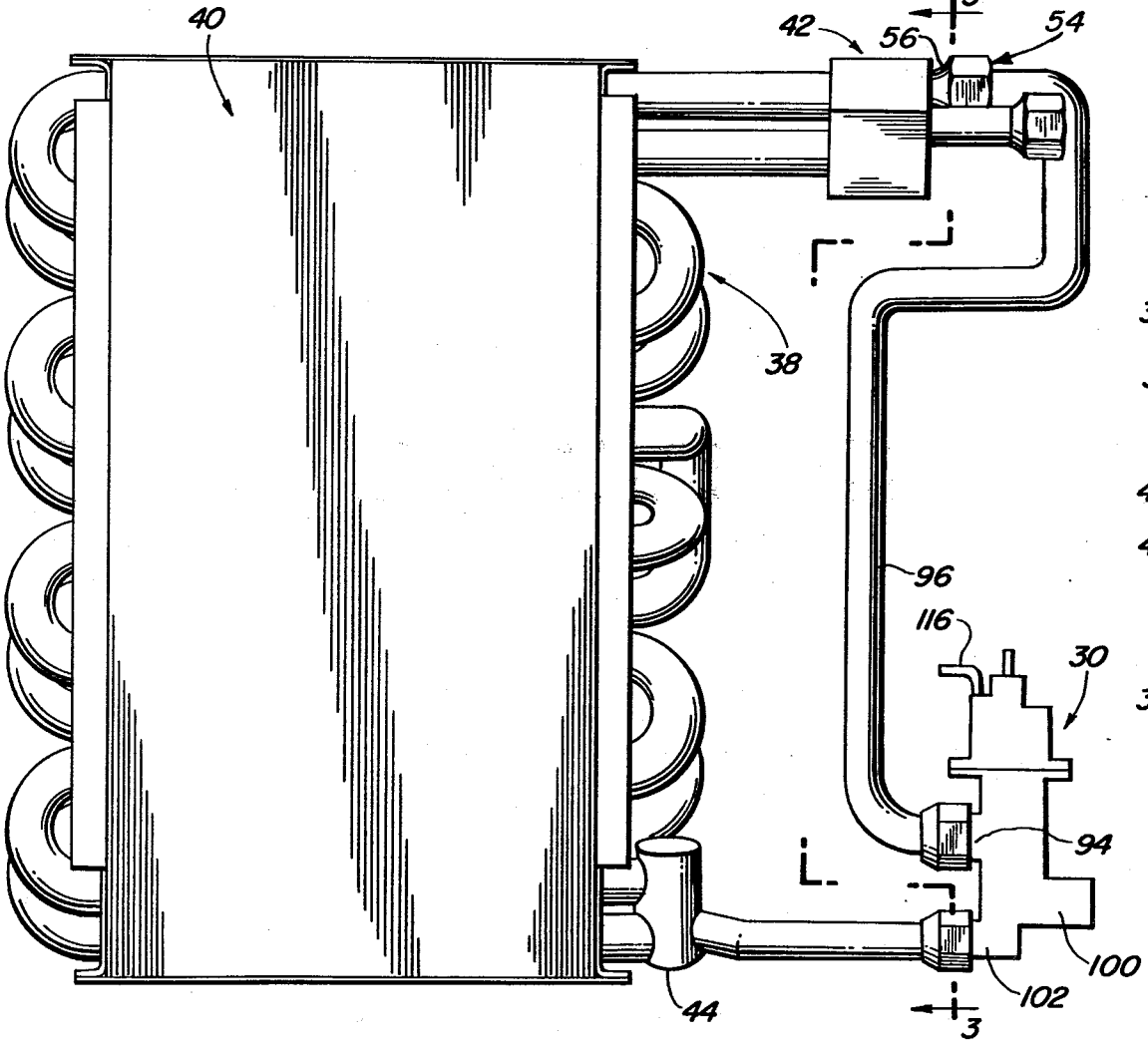
FIG. 2 is a side elevational view of the evaporators and the control valve device, according to the present invention.
Figure 5:
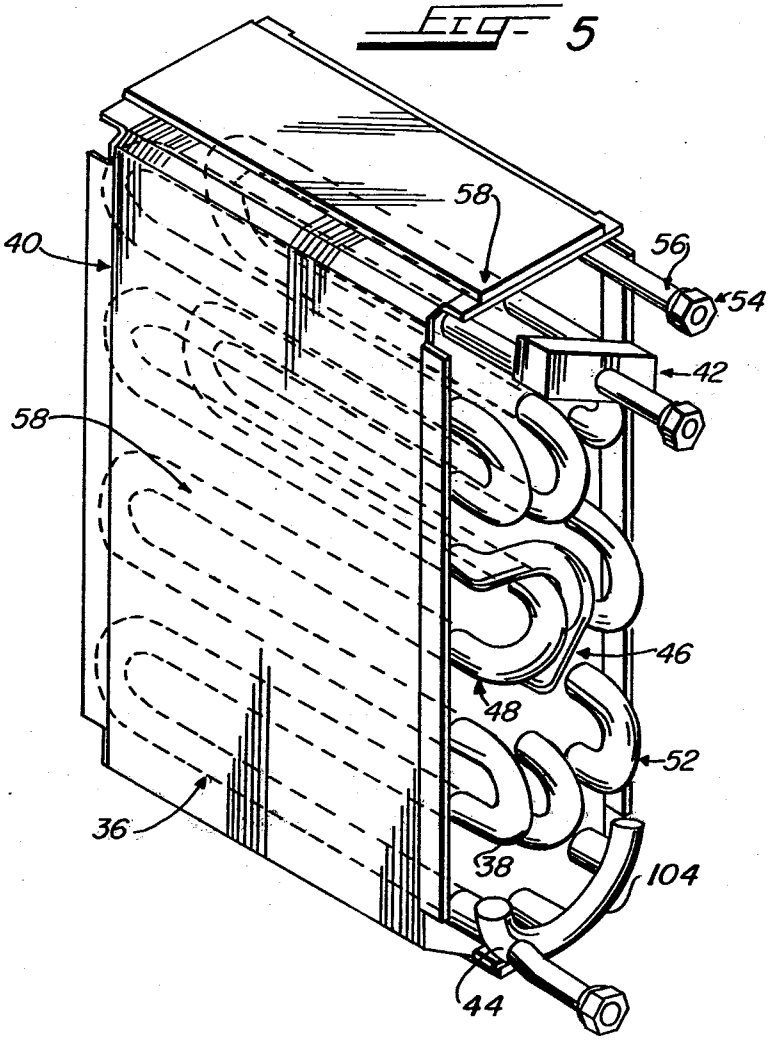
FIG. 5 is a perspective view of the evaporators, according to the present invention.

Referring now in detail to the drawings, there is shown in FIG. 1 a refrigerating apparatus of the present invention comprising a compressor 10, a condenser 12, a refrigerant-oil receiver 14, an expansion device 15, an evaporator feed and control system 16 and a superheat responsive valve 17. Compressed gas is discharged from the compressor 10 via a line 18 to the condenser 12 in which it is condensed and then delivered via a line 20 to the refrigerant-oil receiver 14. The receiver 14 contains a mixture of refrigerant and oil which is conventional in the art. The refrigerant-oil mixture is withdrawn from the receiver 14 through a line 22 via the expansion device 15 to the evaporator system 16 in which liquid refrigerant-oil is expanded to produce the normal cooling effect. Gas from the evaporator system 16 is finally sent through a line 24 to the suction inlet of the compressor 10 via the valve 17. Like reference numerals have been employed throughout the various drawings to designate the like parts.

The automatic expansion device 15 operatively connected between the receiver 14 and the evaporator system 16 is of a pressure-responsive type for maintaining a relatively constant pressure in the evaporators. The constant pressure regulating valve 15 can be of any conventional type similar to that illustrated and described in my earlier U.S. Pat. No. 3,688,516 issued on Sept. 5, 1972. This type of valve senses a drop in pressure to open for permitting more refrigerant to flow and will close upon an increase in pressure. This valve is also provided with means for adjusting the control point to permit various pressure setting for the evaporators.

The superheat responsive valve 17 can be of the type shown and described in my earlier U.S. Pat. No. 3,688,517 issued on Sept. 5, 1972. This latter reference discloses a system for controlling the operation of superheat valve in response to a predetermined change in superheat. Upon a rise in superheat, the valve opens to permit greater flow of refrigerant to the compressor. Upon a drop in superheat, the valve closes which results in reduced flow to the compressor.

In accordance with the invention, the evaporator feed and control system 16 includes a first evaporator 26, a second evaporator 28 and a control valve device 30 as seen in FIGS. 1 through 5. The first evaporator 26 is formed of at least two vertical rows 32, 34 of tubes (FIG. 3) arranged generally in parallel planes and in a preferably downward feed configuration. Each of the tubes consists of straight portions 36 and return-bend coils 38 interconnecting the straight portions 36. The straight portions extend through a series of fins or plates 40 to form common heat-transfer elements. A fluid distributing supply header 42 receives the entering refrigerant-oil mixture from the line 22 through the constant pressure regulating valve 15 and connects to the top terminal ends of the rows 32 and 34 to establish the multiple pass inlet of the first evaporator 26. Return header 44 connects the bottom terminal ends of the rows 32 and 34 to form a single pass outlet for the refrigerant-oil leaving the first evaporator 26. A pair of cross-over conduits 46 and 48 which interlace the two respective rows 32 and 34 substantially halfway between the headers 42 and 44 so as to ensure that the refrigerant-oil is thoroughly mixed at the exit of the header 44 and that each of the rows are equally loaded. It will be understood by those skilled in the art that the evaporator may be formed of any number of rows in parallel planes in excess of two with a corresponding increase in the number of cross-over conduits, but only two rows and cross-over conduits have been shown in the drawings for the convenience of illustration.

The outlet of the header 44 is joined to the inlet of the second evaporator 28 which consists of straight portions 50 and return-bend coils 52 arranged in a single upward-feed configuration. One or more of the straight portions 50 adjacent outlet 54 of the evaporator 28 may be provided with augmenters at 56 such as fins, metallic fibers, special coating and the like to increase gaseous refrigerant heat-transfer for superheating. The remaining straight portions 50 of the evaporator 28 and one or more of the straight portion 36 of the evaporator 26 adjacent the supply header may be coated internally with porous surface at 58 to create immediate boiling of the liquid refrigerant-oil after it enters the evaporator system at the inlet of the header 42.

In this preferred embodiment of the invention, a portion or all of the refrigerant-oil passing in the first evaporator 26 is bypassed the second evaporator 28 by valve means such as the control valve device 30 when the load on the evaporator system 16 is at a predetermined lower or reduced level than the normal full-rated capacity. In this manner of operation, the amount of refrigerant-oil passing directly from the first evaporator through the suction line 24 to the compressor 10 will correspond in accordance with the refrigerating load on the evaporator 16 so as to maintain a high level of stability over the wide range of variable loads.

Figure 4:
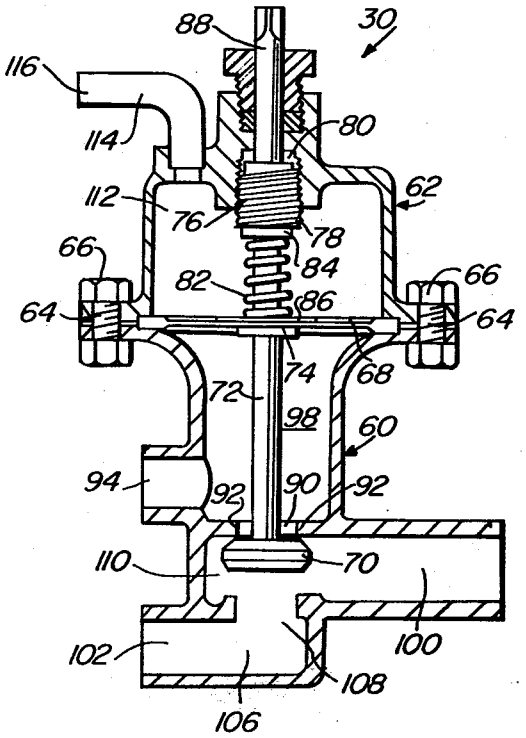
FIG. 4 is a cross-sectional view of the control valve device, according to the present invention.

The details of the control valve device 30 are shown in FIG. 4 of the drawings comprising a lower section 60 and an upper section 62 which are flanged and fixedly secured together by bolts 64 and nuts 66. A diaphragm 68 is clamped between the sections 60 and 62 for controlling the operation of a valve member 70. The valve member 70 is mounted on a valve stem 72 which extends through the diaphragm and is provided with a shoulder 74 formed thereon below the diaphragm 68. The stem 72 extends into a guide bore 76 formed in a sleeve 78. The sleeve is provided with external threads for mating with an internally threaded socket 80. A coil spring 82 surrounds the portion of the stem 72 in the upper section 62 and expands to exert a force at its opposite ends on washers 84 and 86 so as to cause the valve member 70 to be urged downwardly. In order to allow for adjustment in the force exerted by the coil spring 82, the sleeve 78 is attached to a stem 88 which extends through a wall in the upper section 62.

The valve member 70 is positioned below an opening 90 formed by internal flange surfaces 92 in the lower section 60. The opening 90 can be progressively closed by upward movement of the valve member 70 toward the flange surfaces 92. An inlet 94 in the lower section 60 is coupled to the outlet of the second evaporator 28 via a pipe 96 (FIG. 2) and communicates with a chamber 98 in the lower section 60. It can thus be seen that the vertical movement of the stem 72 and valve member 70 controls the amount of refrigerant-oil flowing in the chamber 98 that will be passed through the opening 90 into an outlet chamber 100 connected to the suction line 24. A second inlet 102 in the lower section 60 can be connected directly to the return-header (not shown) or to a tap on a return-bend 104 in the second evaporator 28 for communication with the outlet chamber 100 via chamber 106 and opening 108. In order for vertical movement of the stem 72 to likewise control the amount of refrigerant-oil flowing in the chamber 106 that will be passed through the opening 108 into the outlet chamber 100, the valve member 70 is formed with a downwardly extending tapered section 110 which engages with the opening 108. When the stem 72 is moved downwardly, the opening 108 is progressively closed. It will be understood that as the stem 72 is moved the sizes of the opening 90 and 108 are changed in opposite directions where one of the openings is progressively opened when the other opening is progressively being closed. A chamber 112 is formed in the upper section 62 above the diaphragm 68 and communicates through passage 114 to a third inlet 116 which is coupled to a line 117 ahead of the inlet to the distributing supply header 42. As is best seen in FIG. 4, refrigerant-oil vapor pressure is applied to the lower surface of the diaphragm 68 and pressure from the liquid refrigerant-oil from the output of the constant pressure valve 15 is applied to the other or top of the diaphragm 68.

The initial position of the valve member 70 is determined by the pressure drop across the evaporator 26 and 28. When the pressure drop is high, the valve member 70 closes the opening 108 and both evaporators are utilized. As the refrigerant load decreases, the pressure drop across the evaporators is reduced with a corresponding reduction in the differential pressure across the diaphragm 68 thereby opening the opening 108. Dependent upon this differential pressure on the diaphragm, the position of the stem 72 is caused to move up or down thereby controlling the amount of refrigerant-oil that is bypassed the second evaporator 28 and then delivered directly through the suction line 24 to the compressor 10.

At normal or full-rated loads on the evaporator system 16, the differential pressure on the diaphragm 68 which is dependent upon the pressure drop in the evaporators will cause the valve member 70 to open fully the opening 90 and the opposite section 110 to close fully the opening 108 (opposite to that shown in FIG. 4) so that all of the refrigerant-oil passing in the first evaporator 26 will also pass through the second evaporator 28. When less refrigerant is required due to a lighter load in the evaporator system, it will be recognized that this will increase the superheat and thus the pressure of the refrigerant-oil in the chamber 98 connected to the output of the second evaporator 28 via the inlet 94 of the control valve 30. As a result of this reduction in the load or capacity on the evaporator system, the differential pressure on the diaphragm 68 is correspondingly decreased so that the valve member 70 will progressively close the opening 90 and the tapered section 110 will progressively open the opening 108. At lower relative capacity, the valve member 70 with its opposite section 110 will assume positions as shown in FIG. 4 thereby permitting the refrigerant-oil to bypass the second evaporator 28 and flow directly through inlet 102, opening 108 and chamber 100 to the compressor 110 via the suction line 24 and valve 17.

From the foregoing description of the evaporator feed and control system embodying the present invention, it can be seen that there is provided an evaporator system formed of a first evaporator, a second evaporator and a control valve device responsive to the load conditions and refrigerant pressure drop to bypass all or a portion of the refrigerant-oil from the second evaporator and delivering it directly to the compressor thereby attaining a uniform and high level of satisfactory operation of the system for a wide range of varying loads. Further, the first evaporator of the downflow type is formed of at least two parallel rows of tubes and is arranged with a multiple pass inlet and a single pass outlet with a cross-over halfway between the inlet and outlet so as to ensure an even distribution refrigerant-oil and to supply a thorough mixture at the outlet. Additionally, some of the tubes in the second upflow evaporator may be provided with augmenters to facilitate superheating of the refrigerant-oil, and the tubes in the first evaporator may be coated with a porous surface to ensure immediate boiling of the liquid refrigerant-oil at the entrance of the first evaporator.

While there has been illustrated and described what is at present to be a preferred embodiment of the present invention, it will be understood by those skilled in the art that various changes and modifications may be made and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as a best mode contemplated for carrying out this invention, but the invention will include all embodiments falling within the scope of the appended claims.

What is claimed is:

1. In a refrigerating apparatus, an evaporator feed and control system which maintains a relatively high level of stability over a wide range of varying loads, said evaporator system comprising:

first evaporator means having a multiple pass inlet and a single pass outlet, the inlet being adapted to receive a refrigerant-oil mixture;

second evaporator means having an inlet and an outlet, the inlet of said second evaporator being connected to the output of said first evaporator; and valve means including a first inlet connected to the outlet of said second evaporator, a second inlet connected to the outlet of said first evaporator, a third inlet being responsive to the pressure of refrigerant-oil at the entrance of said first evaporator, and an outlet adapted for bypassing at least a portion of the refrigerant-oil mixture flowing in said first evaporator from the second evaporator directly through a suction line to a compressor when the system is operating at a reduced capacity.

2. In a refrigerating apparatus as claimed in claim 1, wherein said first evaporator means comprises at least two vertical rows of tubes arranged generally in parallel planes and in a downfeed configuration so as to maintain an even distribution of the refrigerant-oil and to maintain a thorough mixture at its outlet.

3. In a refrigerating apparatus as claimed in claim 2, wherein said vertical rows of tubes are crossed-over and interlaced halfway between the inlet and outlet of said first evaporator means.

4. In a refrigerating apparatus as claimed in claim 2, further comprising a supply header connected to the inlet of said first evaporator means to distribute the refrigerant-oil to the rows of tubes and a return header connected to the outlet of said first evaporator to pass refrigerant to the inlet of said second evaporator means.

5. In a refrigerating apparatus as claimed in claim 1, wherein said second evaporator means comprises a single row of tubes arranged in an upward feed configuration.

6. In a refrigerating apparatus as claimed in claim 5, wherein at least one of the tubes adjacent the outlet of said second evaporator means is provided with augmenters to facilitate gaseous refrigerant heat-transfer for superheating.

7. In a refrigerating apparatus as claimed in claim 2, wherein tubes in the first evaporator are coated internally with a porous surface to ensure immediate boiling of liquid refrigerant at the entrance of said first evaporator means.

8. In a refrigerating apparatus, an evaporator feed and control system which maintains a relatively high level of stability over a wide range of varying loads, said evaporator system comprising:

first evaporator means having a multiple pass inlet and a single pass outlet, the inlet being adapted to receive a refrigerant-oil mixture;

second evaporator means having an inlet and an outlet, the inlet of said second evaporator being connected to the output of said first evaporator;

valve means including a first inlet connected to the outlet of said second evaporator, a second inlet connected to the outlet of said first evaporator, and an outlet adapted for bypassing at least a portion of the refrigerant-oil mixture flowing in said first evaporator from the second evaporator directly through a suction line to a compressor when the system is operating at a reduced capacity; and said valve means including a control valve device having a first valve opening and a second valve opening, the first valve opening being opened and closed in response to the differential pressure of the refrigerant across the entrance of said first evaporator means and the exit of said second evaporator means, and the second opening being closed and opened in opposition to the action of the first opening.

* * * * *